US010779086B2

(12) United States Patent
Hedebouw

(10) Patent No.: US 10,779,086 B2
(45) Date of Patent: Sep. 15, 2020

(54) AUDIO PROCESSOR

(71) Applicant: GOODIX TECHNOLOGY (HK) COMPANY LIMITED, Hong Kong (HK)

(72) Inventor: Bram Hedebouw, Heverlee (BE)

(73) Assignee: Goodix Technology (HK) Company Limited, Hong Kong (HK)

( * ) Notice: Subject to any disclaimer, the term of this patent is extended or adjusted under 35 U.S.C. 154(b) by 0 days.

(21) Appl. No.: 16/691,808

(22) Filed: Nov. 22, 2019

(65) Prior Publication Data

US 2020/0204919 A1 Jun. 25, 2020

(30) Foreign Application Priority Data

Dec. 19, 2018 (EP) ..... 18214191

(51) Int. Cl.

| | |
|---|---|
| ***H04R 5/04*** | (2006.01) |
| ***H04R 9/04*** | (2006.01) |
| ***H04R 9/06*** | (2006.01) |

(52) U.S. Cl.

CPC ..... *H04R 5/04* (2013.01); *H04R 9/046* (2013.01); *H04R 9/06* (2013.01)

(58) Field of Classification Search

CPC . H04R 5/04; H04R 9/046; H04R 9/06; H04R 9/00–06; H03G 2201/708

See application file for complete search history.

(56) References Cited

U.S. PATENT DOCUMENTS

| | | | |
|---|---|---|---|
| 5,673,326 | A | 9/1997 | Goldfarb |
| 2004/0086128 | A1 | 5/2004 | Risch et al. |
| 2005/0069150 | A1 | 3/2005 | Kirk |
| 2014/0169571 | A1 | 6/2014 | Polleros |
| 2016/0360331 | A1 | 12/2016 | Yeh |
| 2019/0068152 | A1 | 2/2019 | Gautama |

FOREIGN PATENT DOCUMENTS

| | | | |
|---|---|---|---|
| CN | 103491485 | A | 1/2014 |
| CN | 107809693 | A | 3/2018 |
| DE | 102006052063 | A1 | 5/2008 |
| EP | 3029650 | B1 | 6/2016 |

*Primary Examiner* — Mark Fischer

(57) ABSTRACT

An audio processor for a multi voice coil acoustic transducer is described. The audio processor may receive or generate an audio signal. The audio signal may have one or more phase shifts applied. The audio signal may be used to drive a first coil of a dual voice coil acoustic transducer. The phase-shifted audio signals may drive the other coils of a multi voice-coil acoustic transducer. The phase shift is selected so that the phase difference between the audio signal driving each voice coil may result in destructive interference in the multi voice-coil loudspeaker resulting in reduced or no acoustic output due to the audio signal.

20 Claims, 5 Drawing Sheets

AUDIO PROCESSOR

CROSS-REFERENCE TO RELATED APPLICATIONS

This application claims the priority under 35 U.S.C. § 119 of European Patent application no. 18214191.1, filed on 19 Dec. 2018, the contents of which are incorporated by reference herein.

FIELD

This disclosure relates to an audio processor for acoustic transducers having more than one voice coil.

BACKGROUND

Dual voice coil loudspeakers or speakers typically have two identical voice coils driving a single loudspeaker rather than a single voice coil. The two voice coils may be connected in series or in parallel to alter the loudspeaker impedance when driven by a single amplifier. Alternatively, each of the two voice coils can be driven independently by left and right audio channels of a stereo audio signal, which allows a single speaker to be used to output stereo signals. Dual voice coil loudspeakers may be used in audio systems such as for example vehicle infotainment systems and mobile devices.

SUMMARY

Various aspects of the disclosure are defined in the accompanying claims. In a first aspect there is provided an audio processor for a multi-voice-coil acoustic transducer, the audio processor comprising: at least one phase shifter; and a plurality of audio outputs, each output being configured to be coupled to a respective coil of the multi-coil acoustic transducer: wherein the audio processor is configured to adjust the phase difference between an audio signal supplied to each of the voice coils to attenuate the acoustic output due to the audio signal.

In one or more embodiments, the audio processor may comprise an audio input configured to receive an audio signal; wherein the plurality of audio outputs comprises a first audio output and a second audio output; wherein the first audio output is coupled to the audio input; and the phase shifter comprises a phase inverter having a phase inverter input coupled to the audio input and a phase inverter output coupled to the second audio output: wherein the first audio input is configured to be coupled to the first coil of a dual voice coil acoustic transducer and the second audio output is configured to be coupled to the second coil of the dual voice coil acoustic transducer.

In one or more embodiments, the audio processor may comprise a further audio input configured to receive a further audio signal and a mixer having a first mixer input coupled to the audio input, a second mixer input coupled to the further audio input and a mixer output configured to be coupled to the first audio output.

The second audio output may be further configured to be coupled to a single voice-coil acoustic transducer.

In one or more embodiments, the audio processor may comprise a further mixer having a first further mixer input coupled to the further audio input, a second further mixer input coupled to the phase inverter output, and a further mixer output coupled to the second audio output.

The first audio output may be coupled to an input of a further phase inverter, wherein the further phase inverter output is coupled to a third audio output, wherein the second audio output is further configured to be coupled to the first coil of a further dual voice coil acoustic transducer and the third audio output is configured to be coupled to the second coil of the further dual voice coil acoustic transducer.

In one or more embodiments, the audio processor may comprise a reference signal generator coupled to the audio input. The reference signal generator may be configured to generate a signal at an audible frequency. The reference signal generator may be configured to generate a signal at an inaudible or ultrasound frequency.

In one or more embodiments, the audio processor may comprise a current sensor having an input configured to be coupled to the first voice coil of a dual voice coil acoustic transducer and the second voice coil of the dual voice coil acoustic transducer and an output and a controller having a first controller input coupled to a current sensor and a second controller input coupled to the reference signal generator.

In one or more embodiments, the controller may be configured to determine an acoustic transducer characteristic from a comparison of the reference signal and the detected current signal.

In one or more embodiments, the controller may be configured to determine a difference in a characteristic of the first coil of the dual coil acoustic transducer and the second coil of the dual coil acoustic transducer from a comparison of a detected current signal from the first coil and a detected current signal from the second coil.

In one or more embodiments, the audio processor may comprise an audio compensator arranged between the further audio input and the first further mixer input, wherein the controller has an output coupled to the compensator and wherein the compensator is configured to adapt an audio signal received on the further audio input dependent on the determined difference.

In one or more embodiments, the audio processor may comprise a scaler including the phase inverter, wherein the scaler is adapted to cross-mix the audio input signal and the phase inverted audio signal dependent on a volume control input signal and to output the cross-mixed signal to the second audio output.

Embodiments of the audio processor may be comprised in an audio system comprising a dual voice coil acoustic transducer having a first voice coil coupled to the first audio output and a second voice coil coupled to the second audio output.

Embodiments of the audio processor may be comprised in an audio system comprising a dual voice coil acoustic transducer having a first voice coil coupled to the first audio output and a second voice coil coupled to the second audio output and a further dual voice coil acoustic transducer having a first voice coil coupled to the second audio output and a second voice coil coupled to the third audio output.

In a second aspect, there is provided a method of audio processing for a multi voice coil acoustic transducer, the method comprising: receiving an audio signal: adjusting the phase difference between the audio signal supplied to each of the voice coils to attenuate the acoustic output due to the audio signal.

BRIEF DESCRIPTION OF THE DRAWINGS

In the figures and description like reference numerals refer to like features. Embodiments of are now described in detail, by way of example only, illustrated by the accompanying drawings in which.

DETAILED DESCRIPTION

Figure 1:
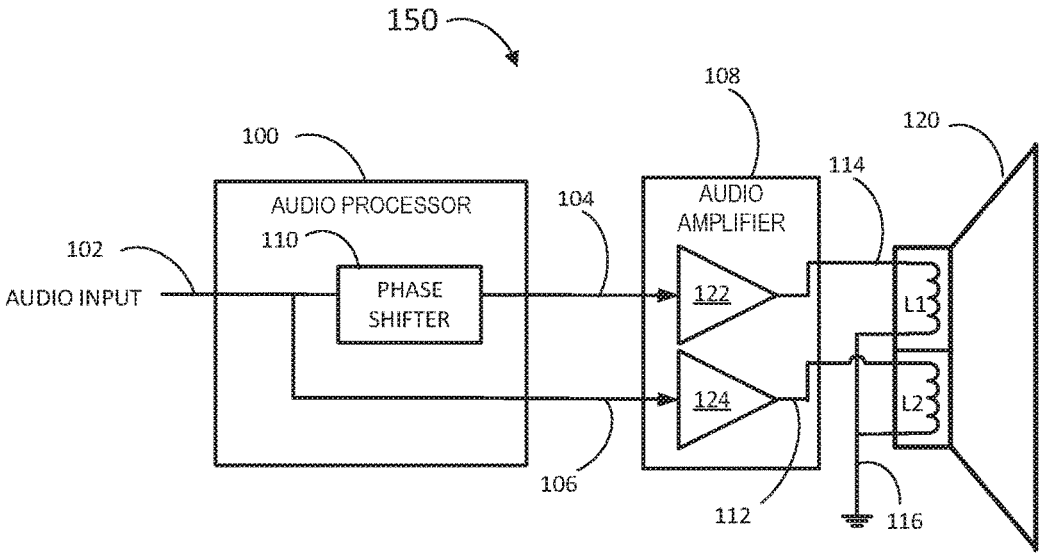
FIG. 1 shows an audio system including an audio processor for a dual-voice coil loudspeaker according to an embodiment.

FIG. 1 shows an audio system 150 including an audio processor 100 for a dual voice coil acoustic transducer according to an embodiment. The audio system 150 may further include an amplifier system 108 and a dual voice coil loudspeaker or speaker 120. The audio processor 100 may have an audio input 102. The audio processor 100 may include a phase shifter 110. The input of the phase shifter 110 may be connected to the audio input 102. An output of the phase shifter 110 may be connected to a first audio processor output 104. The audio input 102 may be connected to a second audio processor output 106. The audio input 102 be connected directly to the second audio processor output 106 or be connected via additional audio processing modules (not shown) included in the audio processor 100.

The audio processor first output 104 may be connected to an input of a first audio amplifier 122 of the audio amplifier system 108 which may be a class-D amplifier. The output 114 of the first amplifier 122 may be connected to a first voice coil L of a dual voice coil loudspeaker 120. The audio processor second output 106 may be connected to an input of a second audio amplifier 124 of the audio amplifier system 108 which may be a class-D amplifier. The output 112 of the second amplifier 124 may be connected to a second voice coil L2 of a dual voice coil loudspeaker 120. As shown in FIG. 1, the amplifier system 108 is connected to the dual voice coil loudspeaker in a single ended configuration with one terminal of L1 and L2 connected to the respective amplifier output 114, 112 and the other terminal connected to ground 116. It will be appreciated that in other examples, the amplifier system 108 may have differential outputs.

In operation, the audio processor 100 may output an audio signal on the second audio processor output 106 and a phase shifted version of the audio signal on the first audio processor output 104. The phase shift applied is chosen such that the audio signal and the phase shifted version of the audio signal will destructively interfere mechanically in the respective voice coils of the dual voice coil loudspeaker 120. For the dual-voice coil loudspeaker 120, this phase shift may be a phase inversion. This destructive interference results in either significantly attenuated or no acoustic output from the dual voice coil loudspeaker 120 due to the audio signal while the current flowing in coils L1, L2 results in power still being dissipated. The inventor of the present disclosure has appreciated that this effect, which may conventionally be considered undesirable, may be used in various audio processing applications as further described herein. In some examples, the audio signal on the audio input 102 may be generated internally in the audio processor 100. In other examples, the audio signal may be received from an external audio source.

The audio processor 100 may be implemented in hardware or a combination of hardware and software, for example software running on a digital signal processor or other microprocessor. The audio processor 100 and the amplifier system 108 may be implemented as separate devices or integrated together as a smart audio amplifier on a single device. In some examples, the phase shifter 110 may be selectively disabled or bypassed dependent on the audio signal and the desired operating mode of the audio system 150.

In some examples other dual voice coil acoustic transducers may also be driven by the audio processor 100. For example, a dual voice coil haptic actuator such as a linear resonant actuator, or more generally electric motors which may be rotating or linear. It will be appreciated that in other examples, acoustic transducers with more than two voice coils may be similarly driven with audio signals being phase shifted to destructively mechanically interfere resulting in reduced or no acoustic output due to those audio signals. The phase shift required for the illustrated audio system 150 may be a phase inversion for a dual voice-coil acoustic transducer. For other multi-coil acoustic transducers, the phase shift may be different. For example, for an even number of identical voice coils where X voice coils are driven with an in-phase audio signal and X voice coils driven with a phase inverted or 180-degree phase shifted audio signal, then cancellation will result. In another example an acoustic transducer using a tri-phase rotating motor required three audio signals with relative phase shifts or phase differences of 120 degrees. In some examples multiple phase shifters may be required.

Figure 2:
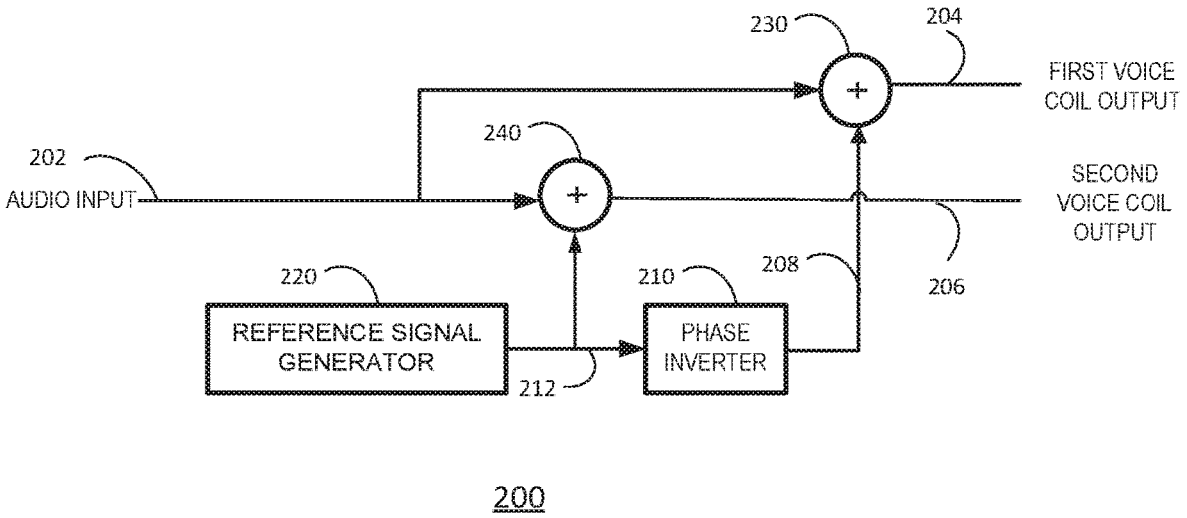
FIG. 2 illustrates an audio processor for a dual-voice coil loudspeaker according to an embodiment.

FIG. 2 shows an audio processor 200 for a dual-coil acoustic transducer according to an embodiment. The audio processor 200 may have an audio input 202 connected to a first input of a first mixer 230. The audio input 202 may be connected to a first input of a second mixer 240. The output 208 of a phase inverter 210 may be connected to a second input of the first mixer 230. The output of the first mixer 230 may be connected to a first audio output 204. The output of the second mixer may be connected to a second audio output 206. The phase inverter 210 may apply a phase shift of 180 degrees to a received signal.

A second input of the second mixer 240 may be connected to an output 212 of a reference signal generator 220. The reference signal generator output 212 may be considered as a further audio input source for the audio processor 200. Consequently, the second input of the second mixer 240 may be considered as an audio input. The reference signal generator output 212 may be connected to an input of the phase inverter 210.

In operation the audio processor 200 is included in an audio system using a dual-voice coil acoustic transducer (not shown). The first audio output 204 may be connected to one of the voice coils of a dual-voice coil acoustic transducer via an audio amplifier (not shown). The second audio output 206 may be connected to the other of the voice coils of a dual-voice coil acoustic transducer via an audio amplifier.

The reference signal generator 220 may generate a signal in the audible frequency range. A further audio signal containing for example speech or music may be received on the audio input 202. The first mixer 230 may mix the further audio signal with a phase inverted version of the reference signal and output the first mixed audio signal on the first audio output 204. The second mixer 240 may mix the further audio signal with the reference signal and output the second mixed audio signal on the second audio output 206.

The reference signal and the phase inverted reference signal destructively interfere mechanically, and the dual voice coil acoustic transducer will not produce any audible sound due to the reference signal. The reference signal may be generated with a relatively large amplitude and still be inaudible even when is generated at an audible frequency. However, the further audio signal will be clearly audible as it is output with the same phase on both voice coils. Although the reference signal will not be audible, a current flow due to the reference signal flows in each of the voice coils. The current flow due to the reference signal and phase-inverted reference signal dissipates power in the voice coils of the dual voice coil acoustic transducer. While this may conventionally be considered undesirable, the inventor of the present disclosure has appreciated that, for example, dual voice coil car speakers which may be subject to low temperature may be self-heated by generating a reference signal of sufficient amplitude which dissipates power in the voice coils. Self-heating the loudspeakers in this way may allow the speakers to perform at an optimal level until the vehicle cabin temperature is at a suitable level. In some examples, the reference signal may be generated at ultrasonic or inaudible frequencies. Because of the destructive interference resulting in no acoustic output due to the reference signal, there may be no interference with other apparatus which uses ultrasound. In addition, because no acoustic output is generated, this may avoid the possibility of an adverse reaction by some animals to an ultrasound signal.

Figure 3:
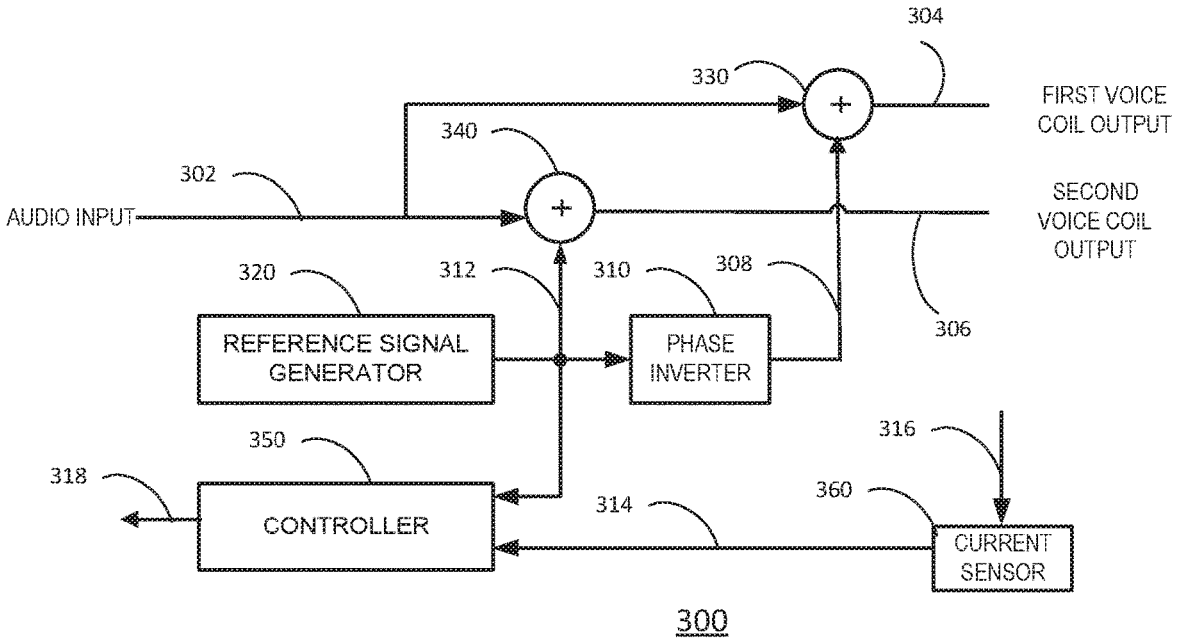
FIG. 3 shows an audio processor for a dual-voice coil loudspeaker according to an embodiment.

FIG. 3 shows an audio processor 300 for a dual-coil acoustic transducer according to an embodiment. The audio processor 300 may have an audio input 302 connected to a first input of a first mixer 330. The audio input 302 may be connected to a first input of a second mixer 340. The output 308 of a phase inverter 310 may be connected to a second input of the first mixer 330. The output of the first mixer 330 may be connected to a first audio output 304. The output of the second mixer 340 may be connected to a second audio output 306.

A second input of the second mixer 340 may be connected to an output 312 of a reference signal generator 320. The reference signal generator output 312 may be considered as a further audio input source. The reference signal generator output 312 may be connected to an input of the phase inverter 310. The reference signal output 312 may be connected to a first input of a controller 350. A second input of the controller 350 may be connected to an output 314 of a current sensor 360. The current sensor 360 may have a current sensor input 316.

In operation the audio processor 300 is included in an audio system using a dual-voice coil acoustic transducer (not shown). The first audio output 304 may be connected to one of the voice coils of a dual-voice coil acoustic transducer via an audio amplifier. The second audio output 306 may be connected to the other of the voice coils of a dual-voice coil acoustic transducer via an audio amplifier. The current sensor input 316 may be connected to each of the voice coils.

The reference signal generator 320 may generate a signal in the audible frequency range. A further audio signal containing for example speech or music may be received on the audio input 302. The first mixer 330 may mix the further audio signal with a phase inverted version of the reference signal and output the first mixed audio signal on the first audio output 304. The second mixer 340 may mix the further audio signal with the reference signal and output the second mixed audio signal on the second audio output 306.

The reference signal and the phase inverted reference signal destructively interfere mechanically, and the dual voice coil acoustic transducer will not produce any audible sound due to the reference signal. The reference signal may be generated with a relatively large amplitude and still be inaudible even when it is generated at an audible frequency. However, the further audio signal will be clearly audible as it is output with the same phase on both voice coils. Although the reference signal will not be audible, a current flow due to the reference signal flows in each of the voice coils. This current flow may be detected by the current sensor 360. The controller 350 may compare the amplitude of the detected current with the generated reference signal and determine an acoustic transducer characteristic value from the comparison.

This characteristic may be for example an impedance value or DC resistance for each of the coils. The DC resistance may be determined from an AC reference signal by determining current flow through one of the voice coils. Typically, the voltage across the dual voice-coil speaker 120 is known and in the ideal case where both voice coils are identical impedance measured will only consist of the DC component. This is because mechanical and inductive parts of the impedance have been cancelled out. The controller 350 may output the characteristic value on the controller output 318. This controller output 318 be connected to a further audio processing module (not shown) which may for example adapt the further audio signal dependent on the measured characteristic. By measuring a characteristic using a reference signal in the audible frequency range and with relatively large amplitude compared to the maximum audio amplitude that the speaker may play, the determination of the characteristic may be more accurate. The amplitude of the reference signal may for example be in a range up to 20% of maximum amplitude of the audio signal for the loudspeaker. In other examples, the amplitude of the reference signal may be greater than 20% of the maximum amplitude of the audio signal for the loudspeaker.

Figure 4:
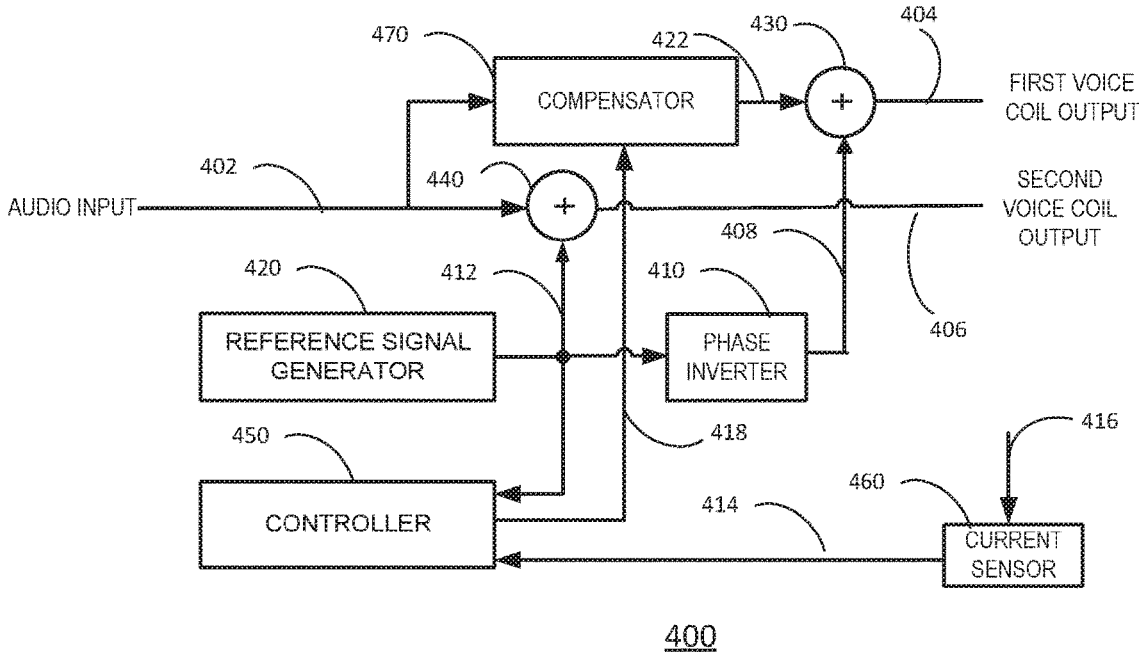
FIG. 4 illustrates an audio processor for a dual-voice coil loudspeaker according to an embodiment.

FIG. 4 shows an audio processor 400 for a dual-coil acoustic transducer according to an embodiment. The audio processor 40X) may have an audio input 402 connected to an input of compensator 470. An output 422 of the compensator 470 may be connected to a first input of a first mixer 430. The audio input 402 may be connected to a first input of a second mixer 440. The output 408 of a phase inverter 410 may be connected to a second input of the first mixer 430. The output of the first mixer 430 may be connected to a first audio output 404. The output of the second mixer 440 may be connected to a second audio output 406.

A second input of the second mixer 440 may be connected to an output 412 of a reference signal generator 420. The reference signal generator output 412 may be considered as a further audio input source. The reference signal generator output 412 may be connected to an input of the phase inverter 410. The reference signal output 412 may be connected to a first input of a controller 450. A second input of the controller 450 may be connected to an output 414 of a current sensor 460. The current sensor 460 may have a current sensor input 416. A controller output 418 may be connected to the compensator 470.

In operation the audio processor 400 is included in an audio system using a dual-voice coil acoustic transducer (not shown). The first audio output 404 may be connected to one of the voice coils of a dual-voice coil acoustic transducer via an audio amplifier. The second audio output 406 may be connected to the other of the voice coils of a dual-voice coil acoustic transducer via an audio amplifier. The current sensor input 416 may be connected to each of the voice coils.

The reference signal generator 420 may generate a signal in the audible frequency range. A further audio signal containing for example speech or music may be received on the audio input 402. The compensator 470 may apply a compensation factor to the further audio signal. This may include equalisation, dynamic range control, or other filtering. The compensator 470 outputs a compensated further audio signal to the first mixer 430. The first mixer 430 may mix the compensated further audio signal with a phase inverted version of the reference signal and output the first mixed audio signal on the first audio output 404. The second mixer 440 may mix the further audio signal with the reference signal and output the second mixed audio signal on the second audio output 406.

The reference signal and the phase inverted reference signal destructively interfere mechanically, and the dual voice coil acoustic transducer will not produce any audible sound due to the reference signal. The reference signal may be generated with a relatively large amplitude and still be inaudible even when it is generated at an audible frequency. However, the further audio signal will be clearly audible as it is output with the same phase on both voice coils. Although the reference signal will not be audible, a current flow due to the reference signal flows in each of the voice coils. This current flow may be detected by the current sensor 460. The controller 450 may compare the amplitude of the detected current with the generated reference signal and determine an acoustic transducer characteristic value from the comparison. This characteristic may be for example an impedance value or DC resistance for each of the coils. The DC resistance may be determined from an AC reference signal by determining current flow through one of the voice coils. Typically, the voltage across the dual voice-coil speaker 120 is known and in the ideal case where both voice coils are identical impedance measured will only consist of the DC component. This is because mechanical and inductive part of the impedance have been cancelled out. However, this is only the case when both voice coils are identical. If the dual voice coils are not perfectly identical, also the difference of mechanical and inductive part will be available in the impedance measured.

The controller 450 may then determine a difference in the characteristic for each of the voice coils from the impedance measurement. The controller 450 may output an error signal corresponding to the difference in the characteristics to the compensator 470. The compensator 470 may adjust or compensate the further audio signal output on the first audio output 404 dependent on this error signal.

The inventor of the present disclosure has further appreciated that although typically the coils of a dual voice coil acoustic transducer are designed to be identical, in practice due to manufacturing variations this is not the case. By measuring the currents due to the reference signal from each coil and determining the difference, the compensator 470 may adapt the further audio signal to account for the difference. In another example, the phase inverter may have a variable gain and the controller may adapt the gain of the phase inverter to compensate the phase-inverted reference signal to improve the destructive cancellation.

Figure 5:
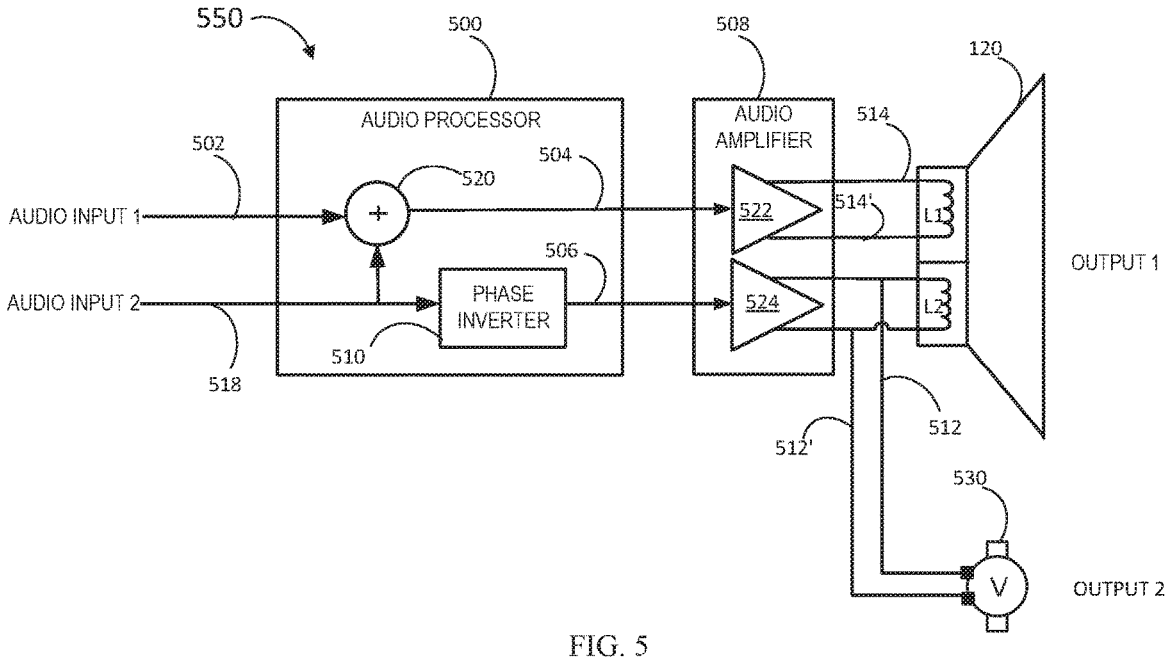
FIG. 5 shows an audio system including an audio processor for a dual-voice coil loudspeaker according to an embodiment.

FIG. 5 shows an audio system 550 including an audio processor according to an embodiment 500. Audio system 550 may include an amplifier system 508, a dual coil loudspeaker 120 and a haptic motor 530. Audio processor 500 has a first audio input 502 connected to a first input of first mixer 520 and a second audio input 518 connected to a second input of first mixer 520 and an input of a phase inverter 510. An output of the mixer 520 is connected to a first audio output 504 An output of the phase inverter 510 is connected to a second audio output 506.

The audio processor first output 504 may be connected to an input of a first audio amplifier 522 of the audio amplifier system 508 which may be a class-D amplifier. The differential outputs 514, 514' of the first amplifier 522 may be connected to a first voice coil L1 of a dual voice coil loudspeaker 120. The audio processor second output 506 may be connected to an input of a second audio amplifier 524 of the audio amplifier system 508 which may be a class-D amplifier. The differential outputs 512,512' of the second amplifier 524 may be connected to a second voice coil L2 of a dual voice coil loudspeaker 120. The second amplifier differential outputs 512,512' may be connected to a haptic motor 530 such as a linear resonant actuator. In other examples other acoustic transducers may be connected instead of the haptic motor 530 such as single voice coil speakers, piezo transducers.

In operation, a first audio signal received on first audio input 502 is mixed with a second audio signal received on the second audio input 518, The mixed audio signal is output on the first audio output 504. The second audio signal is phase inverted by the phase inverter 510 and the phase inverted second audio is output on the second audio output 506.

The second audio signal and the phase inverted version of the second audio signal will destructively interfere mechanically in the respective voice coils of the dual voice coil loudspeaker 120. This destructive interference results in either significantly reduced or no acoustic output from the dual voice coil loudspeaker 120 due to the second audio signal while the current flowing in coils L1, L2 results in power still being dissipated. The second phase-inverted audio signal is received by the haptic motor 530 which may result in an audible output as there is no destructive interference. In some examples the haptic motor 530 may be replaced by a loudspeaker or other acoustic transducer. The audio processor 500 allows amplifier system 508 to be shared between two acoustic transducers if one is a dual voice coil acoustic transducer.

Figure 6:
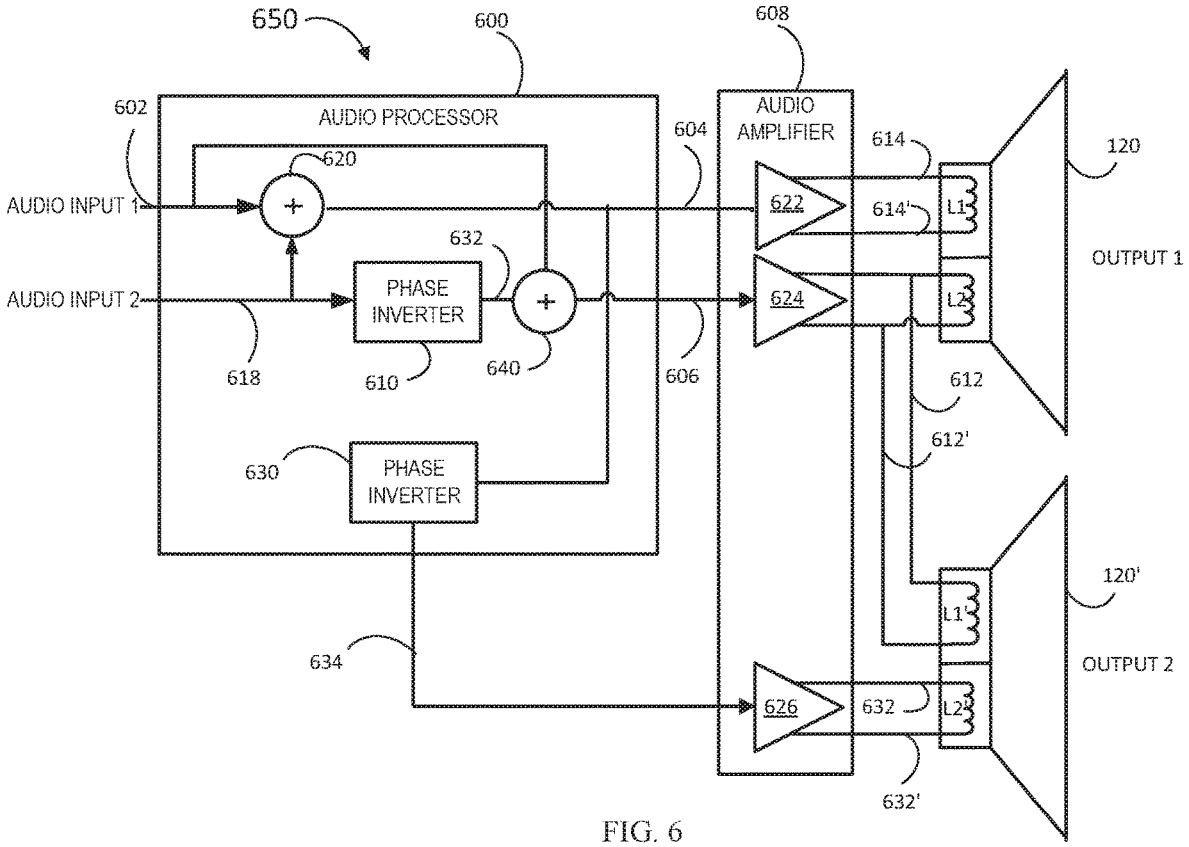
FIG. 6 shows an audio system including an audio processor for a dual-voice coil loudspeaker according to an embodiment.

FIG. 6 shows an audio system 650 including an audio processor 600 according to an embodiment. Audio system 650 may also include an amplifier system 608, a first dual coil loudspeaker 120 and a further dual coil loudspeaker 120'. Audio processor 600 has a first audio input 602 connected to a first input of first mixer 620 and a second audio input 618 connected to a second input of first mixer 620 and an input of a first phase inverter 610. An output of the first mixer 620 is connected to a first audio output 604 An output of the first phase inverter 610 is connected to a first input of a second mixer 640. A second input of second mixer is connected to the first audio input 602. The output of the second mixer is connected to the second audio output 606. The output of the first mixer 620 is connected to an input of a second phase inverter 630. An output of the second phase inverter is connected to a third audio output 634.

The audio processor first output 604 may be connected to an input of a first audio amplifier 622 of the audio amplifier system 608 which may be a class-D amplifier. The differential outputs 614, 614' of the first amplifier 622 may be connected to a first voice coil L1 of a dual voice coil loudspeaker 120. The audio processor second output 606 may be connected to an input of a second audio amplifier 624 of the audio amplifier system 608 which may be a class-D amplifier. The differential outputs 612,612' of the second amplifier 624 may be connected to a second voice coil L2 of a dual voice coil loudspeaker 120. The second amplifier differential outputs 612,612' may be connected to a first voice coil L1' of a second dual voice coil loudspeaker 120'. The third audio output 634 may be connected to a third amplifier 626 in the amplifier system 608. The differential outputs 632, 632' may be connected to a second voice coil L2' of the second dual voice coil loudspeaker 120'

In operation, a first audio signal received on first audio input 602 is mixed with a second audio signal received on the second audio input 618, The mixed audio signal is output on the first audio output 604. The second audio signal is phase inverted by the phase inverter 610. The inverted second audio signal is mixed with the first audio signal and the mixed signal is output on the second audio output 606. The inverted first audio signal is output on the third audio output 634. In this configuration the first audio signal is played through the first dual voice-coil speaker 120 and the second audio signal is played through the second dual voice-coil speaker 120'.

The second audio signal and the phase inverted version of the second audio signal will destructively interfere mechanically in the respective voice coils of the dual voice coil loudspeaker 120. This destructive interference results in either significantly reduced or no acoustic output from the dual voice coil loudspeaker 120 due to the second audio signal while the current flowing in coils L1, L2 results in power still being dissipated. The first audio signal and the phase inverted version of the first audio signal will destructively interfere mechanically in the respective voice coils of the second dual voice coil loudspeaker 120'. This destructive interference results in either significantly reduced or no acoustic output from the second dual voice coil loudspeaker 120' due to the second audio signal while the current flowing in coils L1', L2' results in power still being dissipated. The audio system 650 may allow stereo play back or be used for active cross-over filters if for example the first dual voice coil loudspeaker 120 is a woofer and the second dual voice coil loudspeaker 120' is a tweeter.

Figure 7:
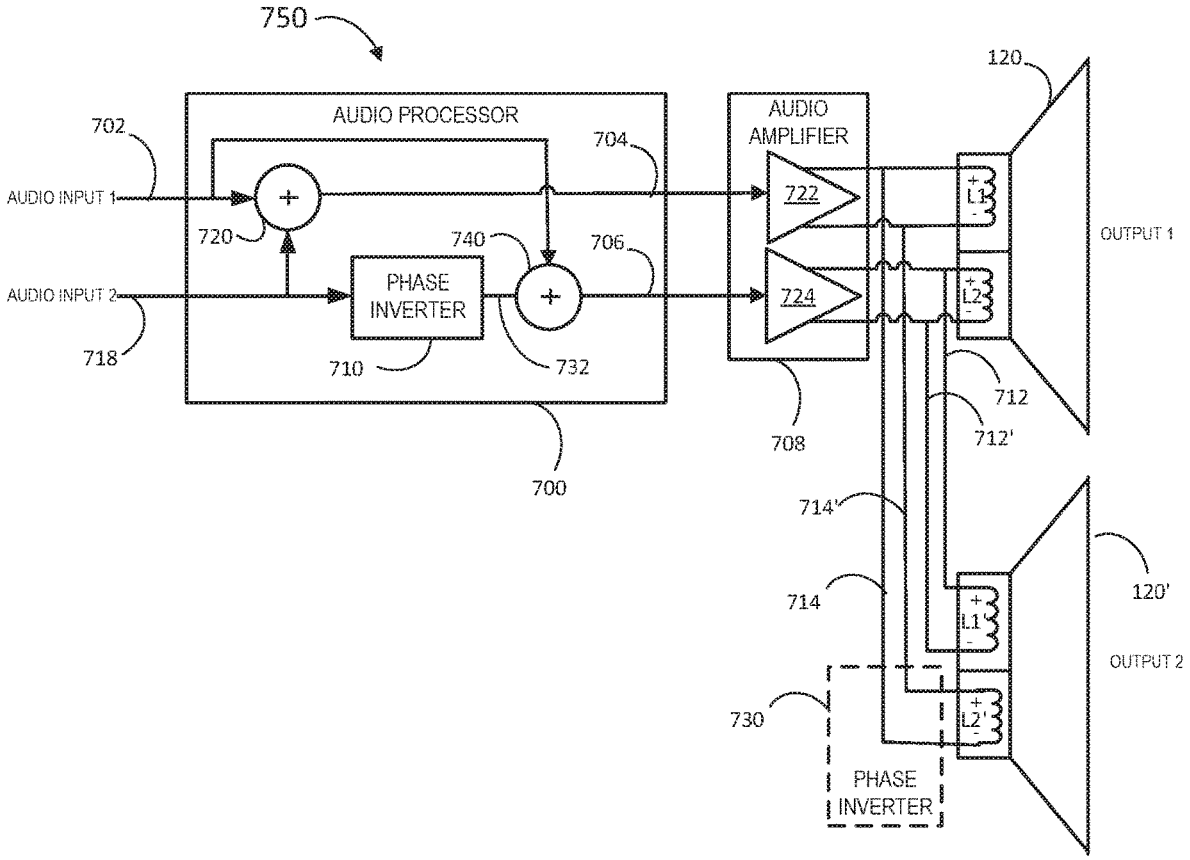
FIG. 7 shows an audio system including an audio processor for a dual-voice coil loudspeaker according to an embodiment.

FIG. 7 shows an audio system 750 including an audio processor 700 according to an embodiment. Audio system 750 may include an amplifier system 708, a first dual coil loudspeaker 120 and a further dual coil loudspeaker 120'. Audio processor 700 has a first audio input 702 connected to a first input of first mixer 720 and a second audio input 718 connected to a second input of first mixer 720 and an input of a first phase inverter 710. An output of the first mixer 720 is connected to a first audio output 704. An output 732 of the first phase inverter 710 is connected to a first input of a second mixer 740. A second input of second mixer 740 is connected to the first audio input 702. The output of the second mixer is connected to the second audio output 706.

The audio processor first output 704 may be connected to an input of a first audio amplifier 722 of the audio amplifier system 708 which may be a class-D amplifier. The differential outputs 714, 714' of the first amplifier 722 may be connected to a first voice coil L1 of a dual voice coil loudspeaker 120. The differential outputs 714, 714' of the first amplifier 722 may be connected to a second voice coil L2' of the second dual voice coil loudspeaker 120' with opposite polarity to the connections to the first voice coil L1 of the dual voice coil loudspeaker 120 and so acts as a second phase inverter 730.

The audio processor second output 706 may be connected to an input of a second audio amplifier 724 of the audio amplifier system 708 which may be a class-D amplifier. The differential outputs 712,712' of the second amplifier 724 may be connected to a second voice coil L2 of a dual voice coil loudspeaker 120. The second amplifier differential outputs 712, 712' may be connected to a first voice coil L1' of a second dual voice coil loudspeaker 120'.

In operation, a first audio signal received on first audio input 702 is mixed with a second audio signal received on the second audio input 718, The mixed audio signal is output on the first audio output 704. The second audio signal is phase inverted by the phase inverter 710. The inverted second audio signal is mixed with the first audio signal and the mixed signal is output on the second audio output 706. In this configuration, similar to the audio system 650, the first audio signal is played through the first dual voice-coil speaker 120 and the second audio signal is played through the second dual voice-coil speaker 120'. In this case only two audio amplifiers 722, 724 are needed to drive two dual-voice coil speakers.

The second audio signal and the phase inverted version of the second audio signal will destructively interfere mechanically in the respective voice coils of the dual voice coil loudspeaker 120. This destructive interference results in either significantly reduced or no acoustic output from the dual voice coil loudspeaker 120 due to the second audio signal while the current flowing in coils L1, L2 results in power still being dissipated. The first audio signal and the phase inverted version of the first audio signal will destructively interfere mechanically in the respective voice coils of the second dual voice coil loudspeaker 120'. This destructive interference results in either significantly reduced or no acoustic output from the second dual voice coil loudspeaker 120' due to the second audio signal while the current flowing in coils L1', L2' results in power still being dissipated. The audio system 750 may allow stereo play back or be used for active cross-over filters if for example the first dual voice coil loudspeaker 120 is a woofer and the second dual voice coil loudspeaker 120' is a tweeter.

Figure 8:
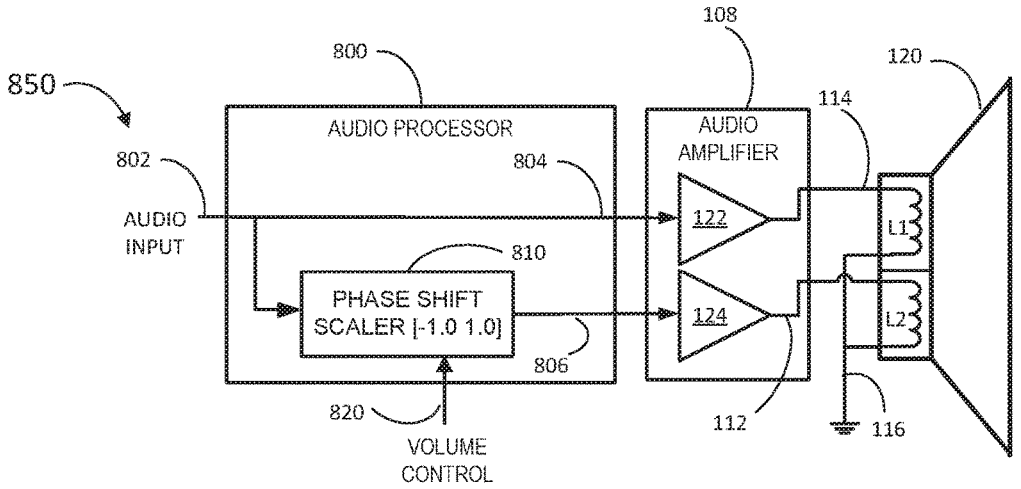
FIG. 8 shows an audio system including an audio processor for a dual-voice coil loudspeaker according to an embodiment.

FIG. 8 shows an audio system 850 including an audio processor 800 for a dual voice coil acoustic transducer according to an embodiment. The audio processor 800 may have an audio input 802. The audio input 802 may be connected directly to the first audio processor output 804 or be connected via additional audio processing modules (not shown) included in the audio processor 800. The input of the phase shift scaler 810 may be connected to the audio input 802. An output of the phase shift scaler 810 may be connected to a second audio processor output 806. The phase shift scaler 810 may have a volume control input 820.

The audio processor first output 804 may be connected to an input of a first audio amplifier 122 of the audio amplifier system 108 which may be a class-D amplifier. The output of the first amplifier 122 may be connected to a first voice coil L1 of a dual voice coil loudspeaker 120. The audio processor second output 806 may be connected to an input of a second audio amplifier 124 of the audio amplifier system 108 which may be a class-D amplifier. The output 112 of the second amplifier 122 may be connected to a second voice coil L2 of a dual voice coil loudspeaker 120. The amplifier system 108 is connected to the dual voice coil loudspeaker 120 in a single ended configuration with one terminal of L1 and L2 connected to the respective amplifier output 112, 114 and the other terminal connected to ground 116.

In operation, the audio processor 800 may output an audio signal on the first audio processor output 804 and a scaled and phase adjusted version of the audio signal on the second audio processor output 806 controlled by the volume control input 820. The effect of this is that dependent on the phase and amplitude of the scaled audio signal, the degree of destructive interference in the respective voice coils of the dual voice coil loudspeaker 120 varies. This destructive interference results in either significantly reduced or no acoustic output from the dual voice coil loudspeaker 120 while the current flowing in coils L1, L2 results in power still being dissipated. When the scaler is set to −1.0 there will be silence, because the audio signal and the scaled phased adjusted signal are destructively interfering. When the scaler set to 1.0 there is maximum output, because the scaled phased adjusted signal and the audio signal are constructively interfering. The audio processor 800 may provide a volume control for the audio system 850. The overall dissipated power in the voice coils varies by a factor of two which may be used for heating the speaker 120. The inventor of the present disclosure has appreciated that this effect may be used to self-heat the dual voice coil loudspeaker 120 even at low volumes.

Figure 9:
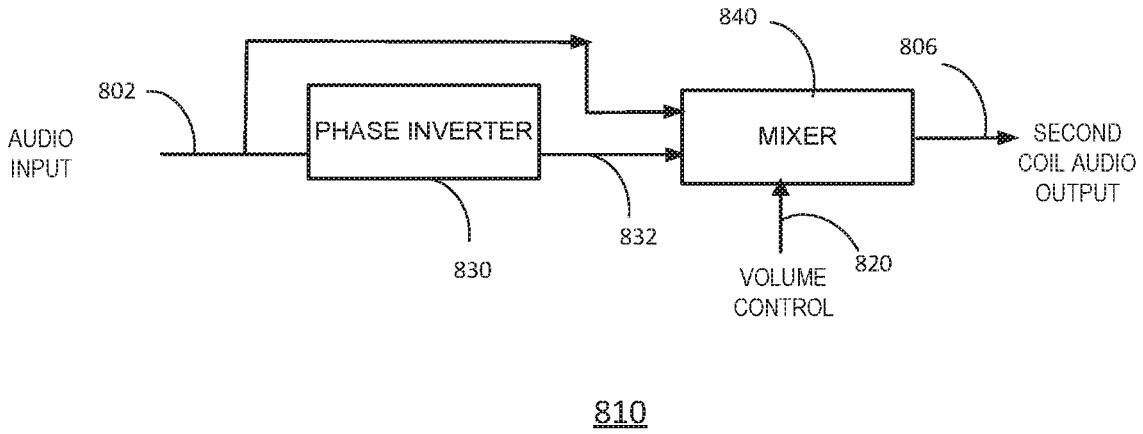
FIG. 9 shows an audio system including an audio processor for a dual-voice coil loudspeaker according to an embodiment.

An example implementation of the phase shift scaler 810 is shown in FIG. 9 including a phase inverter 830 and a mixer 840. The audio input 802 is connected to the input of the phase inverter 830 and a first input of the mixer 840. An output 832 of the phase inverter 830 is connected to a second input of the mixer 840. An output of the mixer 840 is connected to the second audio processor output 806. The output of the phase shift scaler is determined by cross-mixing the in-phase and phase inverted signal determined by the volume control input given by the expression $$\text{Output}=\text{inPhase}*\text{volCtrl}+\text{phaseInv}*(1-\text{volCtrl})$$

Hence, when volCtrl=0, mixer output is the phase inverted signal when volCtrl=0.5, mixer output is 0 when volCtrl=1.0, mixer output is in-phase signal

This way there is a translation between a normal volume scaler range [0.0 1.0] and the scaler required for the dual coil phase inversion. In other examples, the scaler may apply a scale factor between −1 and +1 to the output signal. In this case a value of −1 results in a phase-inverted signal, a value of 0 results in zero output and a value of 1 means the output is in phase.

Figure 10:
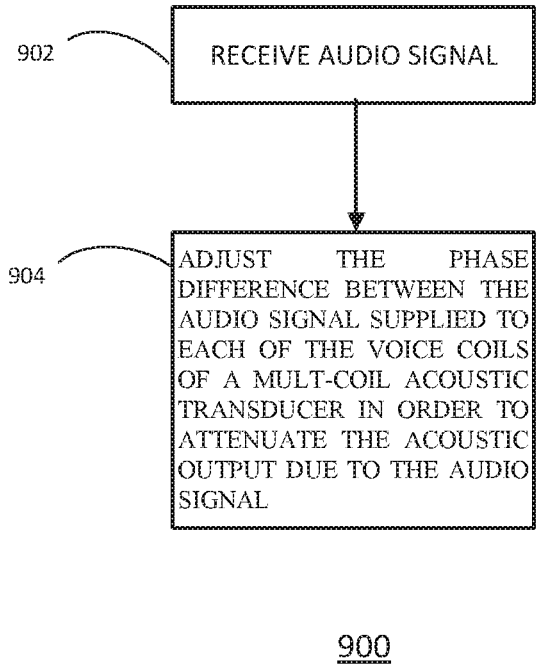
FIG. 10 illustrates a method of driving a multi voice-coil acoustic transducer according to an embodiment.

FIG. 10 shows a method of driving a multi-voice coil acoustic transducer 900. In step 902 an audio signal is received which may be speech, music or a reference signal. In step 904 the phase difference between the audio signal supplied to each of the voice coils of a multi-coil acoustic transducer may be adjusted in order to attenuate the acoustic output due to the audio signal The phase difference between the audio signal applied to each voice coil of the multi voice coil acoustic transducer may be chosen so that the audio signals destructively interfere mechanically, and the multi voice coil acoustic transducer will not produce any audible sound due to the audio signal. The audio signal may be generated with a relatively large amplitude and may still be inaudible even though it is generated at an audible frequency. The method 900 may be used to dissipate power in the voice coil to heat a speaker without generating audible output. Alternatively, or in addition, the current flowing through each voice coil can be measured to monitor some loudspeaker characteristics like the DC resistance.

For example, for a dual voice-coil acoustic transducer, the audio signal which may be a reference signal is fed into the speaker and phase inverted for one coil. The reference signal can then be correlated with the measured current signal to obtain the voltage current relation or impedance. The phase inverted playback will significantly reduce the audibility of the reference signal. The reduced audibility allows a higher-level reference signal to be used which may improve the signal-to-noise ratio of the measurement.

An audio processor for a multi voice coil acoustic transducer is described. The audio processor may receive or generate an audio signal. The audio signal may have one or more phase shift applied. The audio signal may be used to drive a first coil of a dual voice coil acoustic transducer. The phase-shifted audio signals may drive the other coils of a multi voice-coil acoustic transducer. The phase shift is selected so that the phase difference between the audio signal driving each voice coil may result in destructive interference in the multi voice-coil loudspeaker resulting in reduced or no acoustic output due to the audio signal.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

In some example embodiments the set of instructions/method steps described above are implemented as functional and software instructions embodied as a set of executable instructions stored on a non-transitory, tangible computer readable storage medium which are effected on a computer or machine which is programmed with and controlled by said executable instructions. Such instructions are loaded for execution on a processor (such as one or more CPUs). The term processor includes microprocessors, microcontrollers, processor modules or subsystems (including one or more microprocessors or microcontrollers), or other control or computing devices. A processor can refer to a single component or to plural components.

Features which are described in the context of separate embodiments may also be provided in combination in a single embodiment. Conversely, various features which are, for brevity, described in the context of a single embodiment, may also be provided separately or in any suitable sub combination.

The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, a single processor or other unit may fulfil the functions of several means recited in the claims and reference signs in the claims shall not be construed as limiting the scope of the claims.

The invention claimed is:

1. An audio processor for a multi-voice-coil acoustic transducer, the audio processor comprising:

at least one phase shifter; and a plurality of audio outputs, each output being configured to be coupled to a respective coil of the multi-coil acoustic transducer;

wherein the audio processor is configured to adjust the phase difference between an audio signal supplied to each of the voice coils to attenuate the acoustic output due to the audio signal.

2. The audio processor of claim 1 further comprising:

an audio input configured to receive an audio signal;

wherein the plurality of audio outputs comprises a first audio output and a second audio output; wherein the first audio output is coupled to the audio input; and the phase shifter comprises a phase inverter having a phase inverter input coupled to the audio input and a phase inverter output coupled to the second audio output; wherein the first audio output is configured to be coupled to the first coil of a dual voice coil acoustic transducer and the second audio output is configured to be coupled to the second coil of the dual voice coil acoustic transducer.

3. The audio processor of claim 2 further comprising a further audio input configured to receive a further audio signal and a mixer having a first mixer input coupled to the audio input, a second mixer input coupled to the further audio input and a mixer output configured to be coupled to the first audio output.

4. The audio processor of claim 3 wherein the second audio output is further configured to be coupled to a single voice-coil acoustic transducer.

5. The audio processor of claim 3 further comprising a further mixer having a first further mixer input coupled to the further audio input, a second further mixer input coupled to the phase inverter output, and a further mixer output coupled to the second audio output.

6. The audio processor of claim 5 wherein the first audio output is coupled to an input of a further phase inverter, wherein the further phase inverter output is coupled to a third audio output, wherein the second audio output is further configured to be coupled to the first coil of a further dual voice coil acoustic transducer and the third audio output is configured to be coupled to the second coil of the further dual voice coil acoustic transducer.

7. The audio system comprising the audio processor of claim 6 further comprising a dual voice coil acoustic transducer having a first voice coil coupled to the first audio output and a second voice coil coupled to the second audio output and a further dual voice coil acoustic transducer having a first voice coil coupled to the second audio output and a second voice coil coupled to the third audio output.

8. The audio processor of claim 2 further comprising a reference signal generator coupled to the audio input.

9. The audio processor of claim 8 further comprising a current sensor having an input configured to be coupled to the first voice coil of a dual voice coil acoustic transducer and the second voice coil of the dual voice coil acoustic transducer and an output and a controller having a first controller input coupled to a current sensor and a second controller input coupled to the reference signal generator.

10. The audio processor of claim 9 wherein the controller is configured to determine an acoustic transducer characteristic from a comparison of the reference signal and the detected current signal.

11. The audio processor of claim 9 wherein the controller is configured to determine a difference in a characteristic of the first coil of the dual coil acoustic transducer and the second coil of the dual coil acoustic transducer from a comparison of a detected current signal from the first coil and a detected current signal from the second coil.

12. The audio processor of claim 11 further comprising an audio compensator arranged between a further audio input and a first further mixer input, wherein the controller has an output coupled to the compensator and wherein the compensator is configured to adapt an audio signal received on the further audio input dependent on the determined difference.

13. The audio processor of claim 2 further comprising a scaler including the phase inverter, wherein the scaler is adapted to cross-mix the audio input signal and the phase inverted audio signal dependent on a volume control input signal and to output the cross-mixed signal to the second audio output.

14. An audio system comprising the audio processor of claim 2 and further comprising a dual voice coil acoustic transducer having a first voice coil coupled to the first audio output and a second voice coil coupled to the second audio output.

15. A method of audio processing for a multi voice coil acoustic transducer, the method comprising:

receiving an audio signal;

adjusting the phase difference between the audio signal supplied to each of the voice coils to attenuate the acoustic output due to the audio signal.

16. The method of claim 15 further comprising receiving a further audio signal at a further audio input.

17. The method of claim 16, further comprising:

receiving the audio signal at a first mixer input;

receiving the further audio signal at a second mixer input; and generating an output audio signal at a mixer output.

18. The method of claim 16, further comprising determining a difference in a characteristic of a first coil of the multi voice coil acoustic transducer and a second coil of the multi voice coil acoustic transducer from a comparison of a detected current signal from the first coil and a detected current signal from the second coil.

19. The method of claim 18, further comprising adapting an audio signal received at the further audio input dependent on a determined difference.

20. The method of claim 15, further comprising cross-mixing the audio input signal and a phase inverted audio signal dependent on a volume control input signal and outputting the cross-mixed signal to a second audio output.

* * * * *